US006354927B1

(12) United States Patent
Natalicio

(10) Patent No.: US 6,354,927 B1
(45) Date of Patent: Mar. 12, 2002

(54) MICRO-ADJUSTABLE WAFER RETAINING APPARATUS

(75) Inventor: John Natalicio, Los Angeles, CA (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/577,760

(22) Filed: May 23, 2000

(51) Int. Cl.[7] ..... B24B 5/00
(52) U.S. Cl. ..... 451/287; 451/398; 451/285
(58) Field of Search ..... 451/287, 286, 451/285, 384, 385, 397, 398

(56) References Cited

U.S. PATENT DOCUMENTS

| | | | | |
|---|---|---|---|---|
| 4,141,180 A | | 2/1979 | Gill, Jr. et al. | |
| 5,449,316 A | | 9/1995 | Strasbaugh | |
| 5,643,061 A | * | 7/1997 | Jackson et al. | 451/289 |
| 5,679,065 A | | 10/1997 | Henderson | |
| 5,681,215 A | | 10/1997 | Sherwood et al. | |
| 5,851,140 A | | 12/1998 | Barns et al. | |
| 6,206,786 B1 | * | 3/2001 | Quek | 451/287 |

* cited by examiner

*Primary Examiner*—Derrish H. Banks
*Assistant Examiner*—David B. Thomas
(74) *Attorney, Agent, or Firm*—Snell & Wilmer, L.L.P.

(57) ABSTRACT

An easily adjustable wafer retaining ring for both coarse and micro-adjustable engagement with a carrier head assembly of a chemical-mechanical polishing apparatus is disclosed. The carrier head supports the wafer on a wafer support surface during the polishing process. The wafer is held in place by a wafer retaining ring which has an inner and an outer set of threads around the inner and outer circumferences of the retaining ring. The carrier head has engagement means for engaging the retaining ring using the inner and outer threads of the retaining ring. The lower surface of the retaining ring has a groove, preferably, v-shaped which is in contact with the carrier head and parallel to the plane of rotational engagement of the retaining ring with the carrier head. A locking ring is receivably engageable with the groove of the retaining ring. A lock limits further vertical displacement of the retaining ring by bearing pressure down on the locking ring. The carrier head is attached to a fixed ring by retaining ring bolts. The bolts provide for a coarse adjustment of the vertical displacement of the retaining ring by threadably engaging the retaining ring with the carrier head to a predetermined depth relative to the wafer support surface. The bolts provide for a fine adjustment of the vertical displacement of the retaining ring, by using the lock to provide pressure to engage the locking ring with the retaining ring in order to limit further vertical displacement of said retaining ring.

11 Claims, 9 Drawing Sheets

MICRO-ADJUSTABLE WAFER RETAINING APPARATUS

TECHNICAL FIELD OF THE INVENTION

The present invention relates generally to carrier assemblies for use in a chemical mechanical polishing system, and more particularly to micro-adjustable positional control of a retaining ring on a carrier head for the chemical mechanical polishing of wafers.

BACKGROUND OF THE INVENTION

The increasing demand for integrated circuit devices has sparked a corresponding increase in demand for semiconductor wafers from which integrated circuit chips are made. The need for higher density integrated circuits, as well as the need for higher production throughput of integrated circuits on a per-wafer basis, has resulted in a need for increasing the planarity of the semiconductor wafer surface, both during initial production of the semiconductor wafer as well as during the actual building of the integrated circuit on the wafer surface. This need for increased planarity of semiconductor wafer surfaces presents heretofore unresolved challenges in the chemical mechanical polishing (CMP) art.

Integrated circuits are typically formed on substrates, particularly silicon wafers, by the iterative deposition of conductive, semiconductive or insulative layers. After each layer is deposited, that layer is etched to create circuit components. As a series of layers are iteratively deposited and etched, the exposed outermost surface of the substrate becomes increasingly non-planar. This occurs because the distance between the outer surface and the underlying substrate is greatest in regions of the substrate where the least etching has occurred, and least in regions where the greatest etching has occurred. With a single circuit-pattern layer, this non-planar surface comprises a series of peaks and valleys where the distance differential between the highest peak and lowest valley may be on the order of $7\times10^3$ to $10\times10^3$ Angstroms. With the construction of multiple circuit-design layers, the vertical differential between the peaks and valleys becomes increasingly divergent, and can reach several microns resulting in the production of defective devices. In order to manufacture ultra-high density integrated circuits, CMP processes must provide a highly planar surface that is uniform across the entire surface so that the geometries of the component parts of the circuits can be accurately positioned across the full surface of the wafer. Therefore, it is important to consistently and accurately produce a wafer surface that is uniformly planar.

Non-planar substrate surfaces present problems for the manufacturers of integrated circuits. If the outer surface of the substrate is not planar, a photoresist layer placed thereon will also be non-planar. The photolithographic apparatus used to pattern the photoresist typically has a depth of focus of about 0.2 to 0.4 microns for sub-half-micron sized features. If the photoresist layer is sufficiently non-planar, i.e., if the maximum vertical differential of any peak and any valley on the outer surface is greater than the depth of focus of the imaging apparatus, it will be impossible to properly focus the image onto the outer surface. Even if the imaging apparatus can accommodate the non-planarity created by a single patterned layer, after the deposition of a sufficient number of circuit layers, the maximum height differential will exceed the depth of focus.

Chemical mechanical polishing processes are frequently used to planarize the surface layer of a wafer in the production of ultra-high density integrated circuits. In the CMP process, the carrier head provides a controllable load on the substrate to push it against the polishing pad. In addition, the carrier head may rotate to provide additional motion between the substrate and polishing pad. A polishing slurry, including an abrasive and at least one chemically-reactive agent, is spread on the polishing pad to provide an abrasive chemical solution at the interface between the pad and wafer substrate. CMP is a fairly complex process, and differs from simple wet sanding. In the CMP process, the chemically reactive agent in the slurry reacts with the outer surface of the substrate to form reactive sites. The interaction of the polishing pad and abrasive particles with the reactive sites results in polishing of the wafer substrate.

As the polishing pad rotates, it tends to pull the substrate from beneath the carrier head. To eliminate this problem, carrier heads are typically constructed with a downwardly projecting retaining ring. The retaining ring extends circumferentially around the edge of the wafer substrate and forms a recess which retains the wafer beneath the carrier head. The retaining ring prevents the wafer from sliding out from under the carrier assembly due to the lateral urging force of the polishing process. The size, shape, location and mounting of the retaining ring are of critical importance to achieving an optimally planar polishing of wafer substrates. Prior to the instant invention, wafer retaining rings have been designed for static, non-adjustable and/or floating engagement with the carrier head assembly.

In a typical application, a circular retaining ring fully encloses the wafer, narrowly constraining the wafer's radial displacement during the CMP process. The face of the retaining ring closest to the polishing pad is located at a slight distance behind the outer plane of the wafer being polished so as to retain the wafer yet allow the slurry media to penetrate within.

The actual location of the retaining ring in vertical relation to the wafer must be held within very narrow limits, in the range of 0.01 mm, in order to obtain consistent results from carrier assembly to carrier assembly and from wafer substrate to wafer substrate. Because of the time consuming nature of achieving consistent positional deployment of the retaining ring in manufacturing and production environments, a number of schemes have been tried in attempts to mitigate or alleviate this problem. Prior to the instant invention, these attempts to achieve finely-resolved and reproducible positional control of retaining ring deployment have failed to provide an economical solution to the problem.

Very small deviations in the uniformity of the pressure applied to the wafer substrate across the surface of the substrate can result in defects and imperfections in the planarization process. Planarization need only be performed, however, when necessary to prevent the peak-to-valley differential from exceeding the depth of photolithographic focus, or it may be performed each time a new layer is deposited over a developed circuit layer.

An effective CMP process provides a high polishing rate and generates a substrate surface that is finished (i.e., lacks small-scale roughness) and flat (i.e., lacks large-scale topographic differentials). The polishing rate, finish and flatness are determined by the pad and slurry combination, the relative speed between the substrate and pad, the force pressing the substrate against the pad, and the size, shape, and positional location of the wafer retaining ring. Given these constraints, both the polishing time needed to achieve the required finish and flatness, and the pre-production time needed to position and securely retain the wafer substrate on the carrier head determines the maximum throughput of CMP production.

Several parameters influence the uniformity of a planarized surface of a wafer substrate, one of which is that the wafer retaining ring of the carrier assembly sometimes becomes incapable of maintaining the wafer in a position on the support surface or the wafer pad because the exposed surface of the retaining ring is positioned an insufficient distance below the support surface. As a result, the exposed surface of the wafer projects a substantial distance below the exposed surface of the retaining ring. When the wafer slips from its position beneath the wafer carrier, it is usually broken which requires the wafer to be discarded. While the retaining ring could more securely hold the wafer in position by positioning the exposed surface of the retaining ring further below the support surface, doing so decreases the uniformity of slurry distribution between the exposed surface of the wafer and the polishing pad and causes increased wear and tear of both the retaining ring and polishing pad. Therefore, a need exists for an adjustable retaining ring assembly capable of both coarse and fine adjustment of the vertical displacement of the retaining ring relative to both the carrier head assembly and the wafer substrate.

Presently known wafer carrier assemblies are unsatisfactory in several regards, resulting in compromised planarization of the finished semiconductor wafer or other workpiece. An improved semiconductor wafer carrier assembly is thus needed which overcomes the shortcomings of the prior art.

A recurring problem in chemical mechanical polishing is the so-called "edge effect", i.e., the tendency of the substrate edge to be polished at a different rate than the center of the substrate. The edge effect typically results in over-polishing or under-polishing (the removal of too much or too little material from the substrate) of the perimeter portion, e.g., the outermost five to ten millimeters of the substrate. The over-polishing or under-polishing of the substrate perimeter reduces the overall flatness of the substrate, makes the edge of the substrate unsuitable for use in integrated circuits, and decreases the production throughput and yield.

An additional consideration in the production of integrated circuits is process and product stability (i.e., quality control). To achieve a high yield (i.e., a low defect rate), each developed circuit layer should be polished under substantially identical conditions. Each substrate should be polished approximately the same amount so that each integrated circuit is substantially indistinguishable from any other similar type of integrated circuit produced from a different wafer lot.

Many presently known carrier assemblies require the utilization of shims to pre-position the retained wafer to a near-planar orientation within the carrier assembly prior to polishing. The purpose of using shims is to adjust the height of the wafer substrate in order to bring the wafer substrate into near parallel alignment with the vertical global axis of the carrier. Proper pre-polish shimming of a wafer is a multi-step, time consuming process. After the wafer is initially loaded, a measurement of the alignment of the wafer's normal projection on the vertical global axis of the carrier is determined. The operator must then decouple the wafer from the carrier assembly and install shims to bring the plane of the wafer's surface into better alignment. The wafer is then recoupled to the carrier assembly after which another measurement of the planar alignment of the wafer is made. This process of decoupling, shimming and recoupling the wafer to the carrier assembly can proceed for several iterations and typically takes a considerable amount of time.

In view of the foregoing, there is a need for a polishing apparatus that optimizes polishing throughput while providing the desired surface flatness and finish. There is also a need for a wafer carrier assembly that securely maintains the wafer in position in the carrier assembly yet allows a uniform distribution of slurry between the exposed surface of the wafer and the polishing pad without permitting the retaining ring to physically engage the polishing pad. Specifically, there is a need for a wafer carrier assembly with a micro-adjustable retaining ring to permit the operator to optimize the vertical position of the wafer retaining ring relative to the exposed surface of the wafer.

SUMMARY OF THE INVENTION

The instant invention is a wafer retaining device of use with a chemical-mechanical polishing device. The wafer retaining device is capable of both coarse and fine adjustment.

The wafer retaining device includes a carrier head. The carrier head supports the wafer on a wafer support surface during the polishing process.

The wafer is held in place by a wafer retaining ring. The wafer retaining ring has an inner set of threads around the inner circumference of the retaining ring and an outer set of threads around the outer circumference of the retaining ring. The carrier head has engagement means for engaging the retaining ring using the inner and outer threads of the retaining ring.

The upper surface of the retaining ring has a groove, preferably, v-shaped. The groove is in contact with the carrier head and parallel to the plane of rotational engagement of the retaining ring with the carrier head. A locking ring is receivably engageable with the groove of the retaining ring. The locking ring limits the vertical displacement of the retaining ring by bearing pressure down on the retaining ring.

The locking ring is secured in place by retaining ring bolts. The bolts provide adjustment of the vertical displacement of the retaining ring by threadably engaging the locking ring ensuring the depth relative to the wafer support surface. The bolts provide for a fine adjustment of the vertical displacement of the retaining ring providing pressure to engage the locking ring with the retaining ring in order to limit further vertical displacement of said retaining ring.

BRIEF DESCRIPTION OF THE DRAWINGS

The features and advantages of the instant invention reside in the details of construction and operation as more fully depicted, described and claimed hereinafter; reference being had to the accompanying drawings forming a part hereof, wherein like numerals refer to like parts throughout. Other features and advantages will become apparent to those skilled in the art in light of certain present preferred embodiments recited in the detailed description of the drawings, wherein:

DETAILED DESCRIPTION

The present invention is a device for providing a rapid, precise and reproducible method of vertically positioning a wafer retaining ring relative to a wafer for the chemical mechanical polishing of the wafer. The device is capable of both coarse and fine adjustment.

Figure 1:
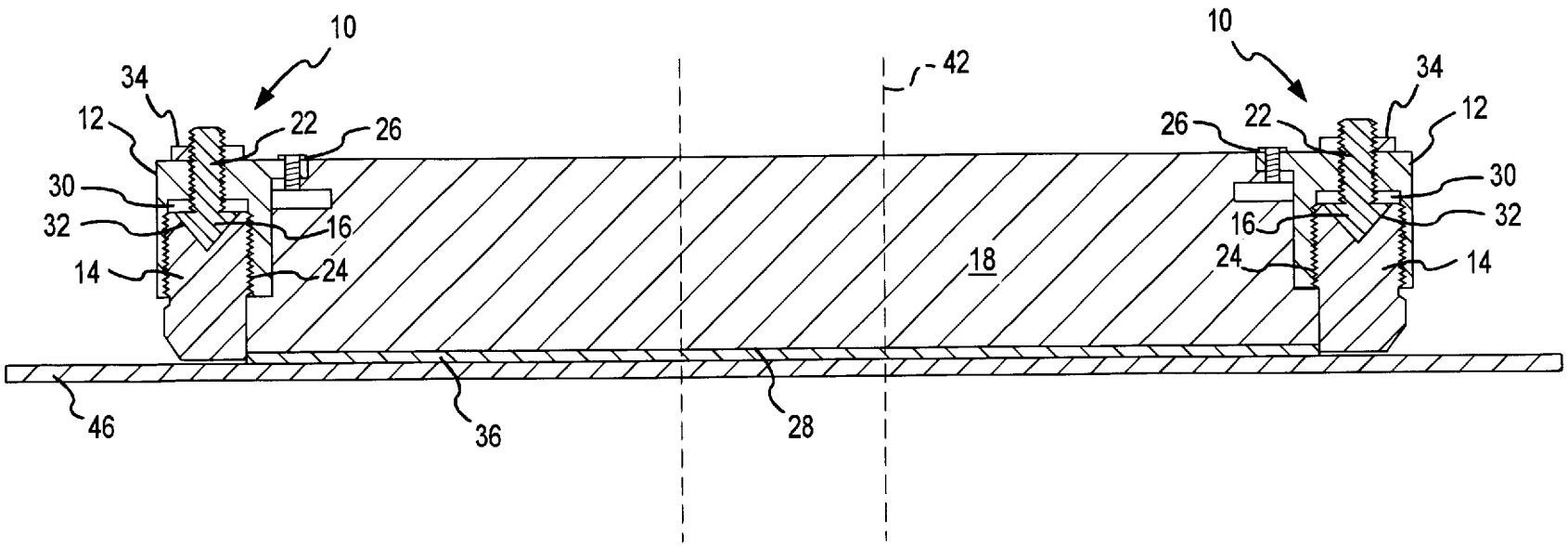
FIG. 1 is a perspective view of a retaining ring assembly formed in accordance with the instant invention.
Figure 2:
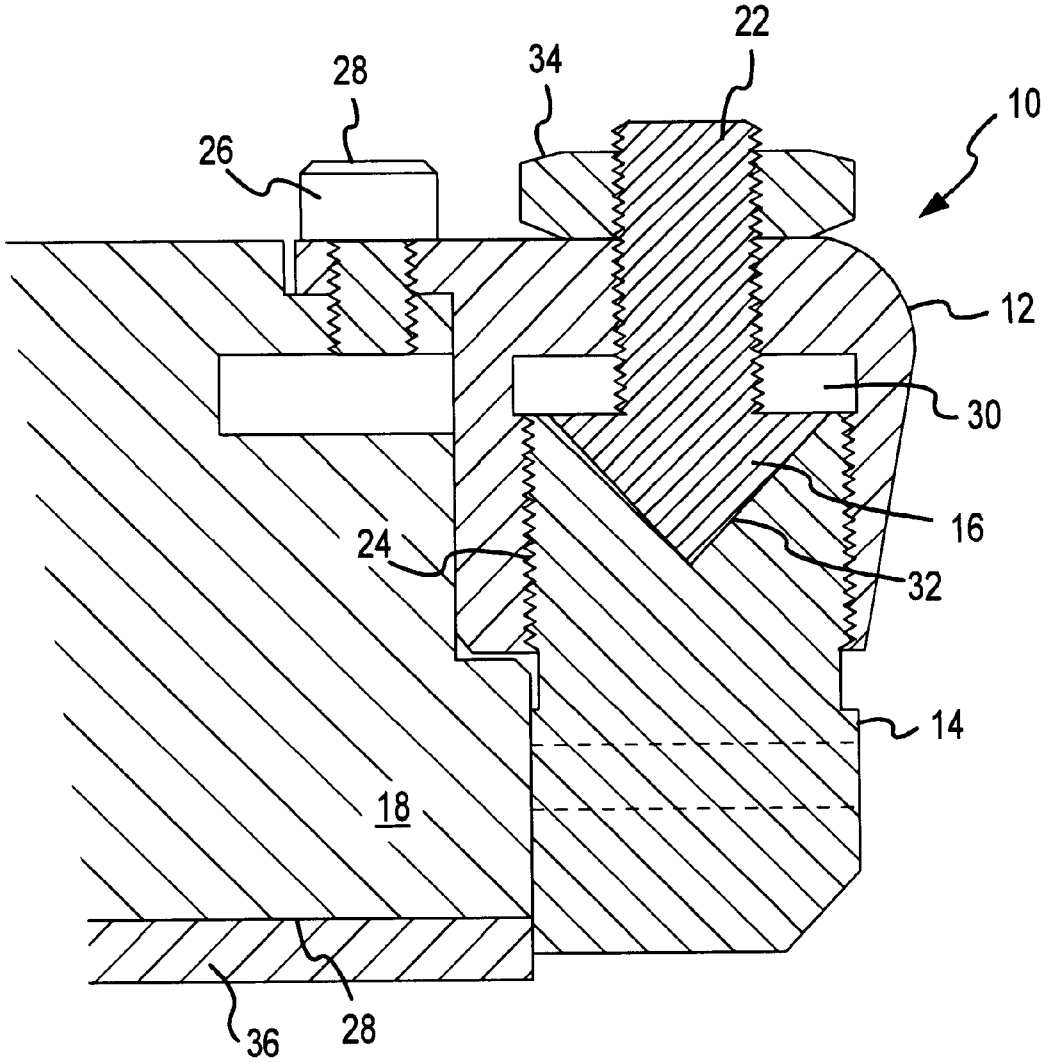
FIG. 2 is a cut-away side view of the retaining ring assembly of FIG. 1.

FIG. 1 and FIG. 2 are a perspective view and a cut-away side view, respectively, of a retaining ring assembly formed in accordance with the instant invention. A carrier head 18 is mounted on a CMP machine shaft 42. The shaft 42 is driven by a motor (not shown) which causes the shaft to rotate. Carrier head 18 rotates around the shaft 42 during the CMP process.

Figure 3:
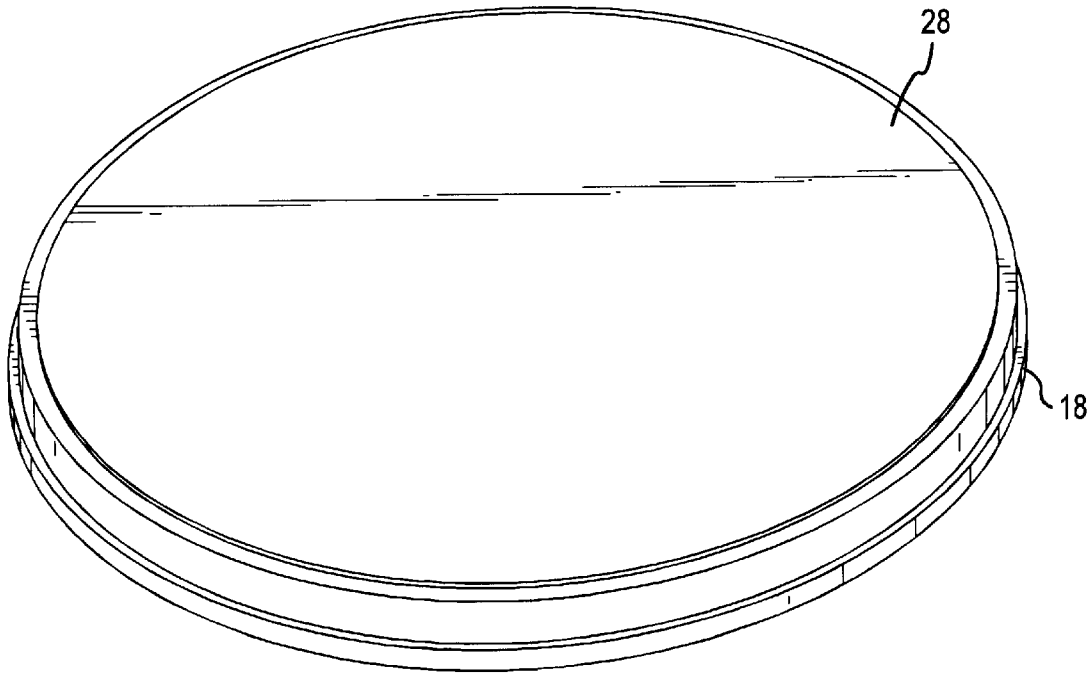
FIG. 3 illustrates the carrier head of the instant invention.
Figure 4:
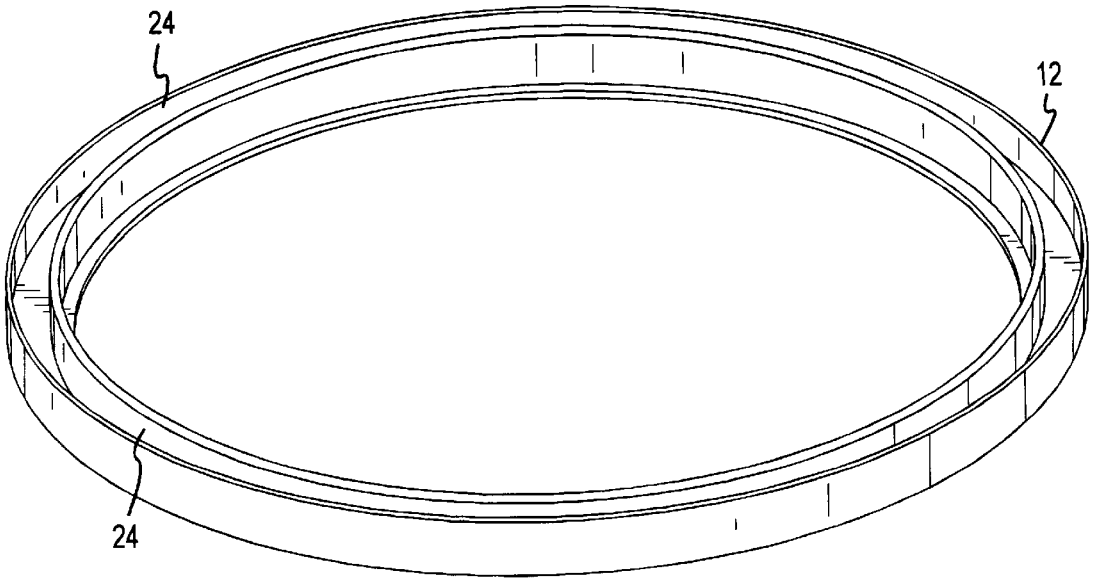
FIG. 4 illustrates the fixed ring of the instant invention.
Figure 5:
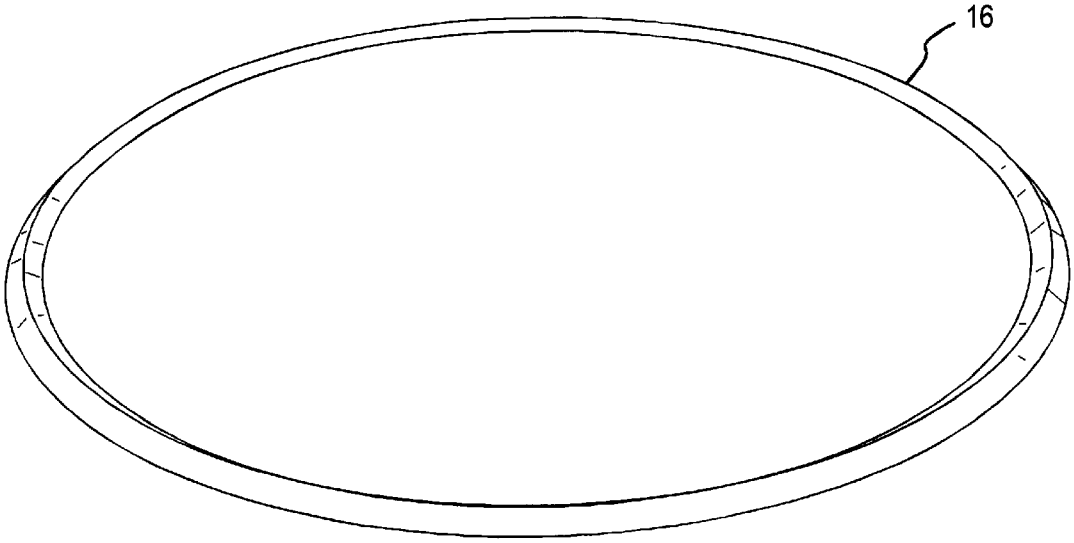
FIG. 5 illustrates the v-shaped locking ring of the instant invention.
Figure 6:
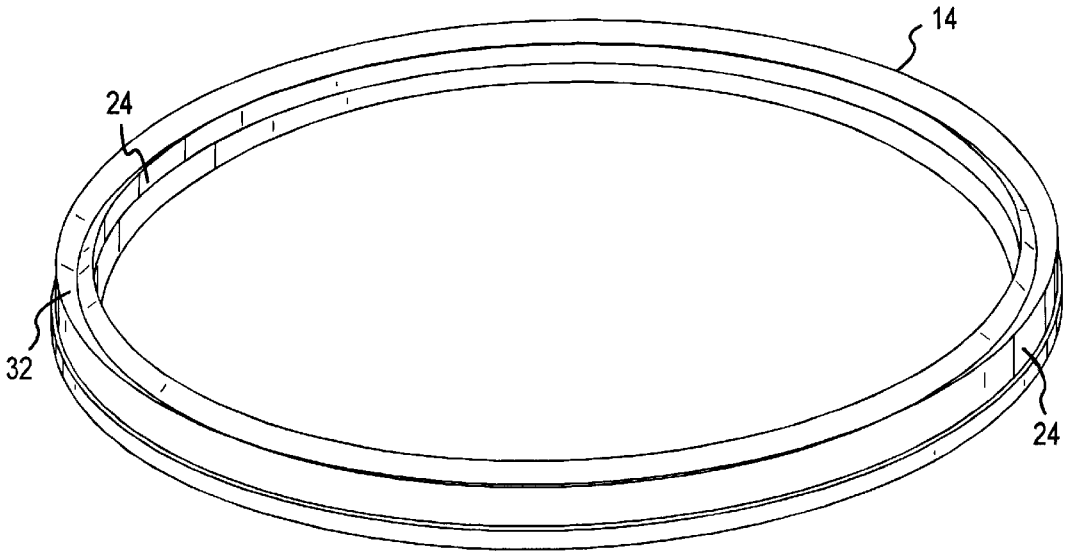
FIG. 6. illustrates the retaining ring of the instant invention.
Figure 7:
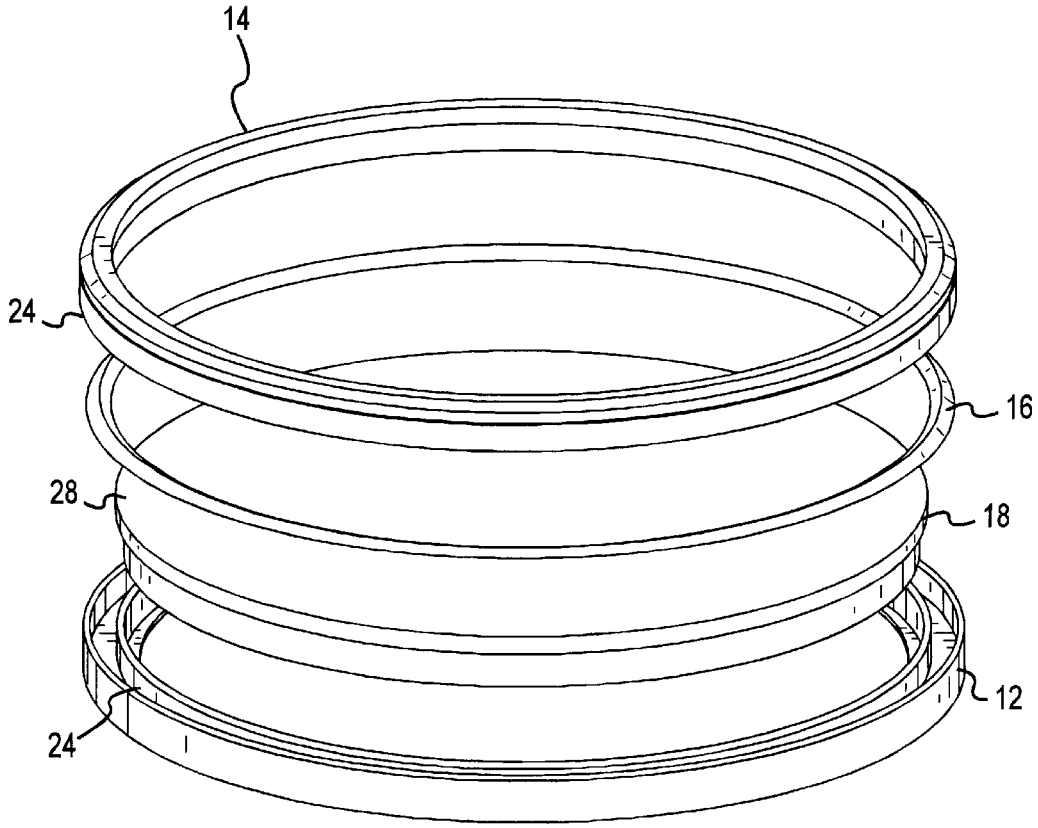
FIG. 7 illustrates the relationship among the retaining ring of FIG. 6, the v-shaped locking ring of FIG. 5, the carrier head of FIG. 3 and the fixed ring of FIG. 4.

A retaining ring assembly 10 is made of a fixed ring 12 preferably fabricated from a metal material, for example, stainless steel. Ring 12, which is shown in detail in FIG. 4, is connected with bolts 26 to carrier head 18 shown in detail in FIG. 3. Carrier head 18 has lower surface 28 for supporting a wafer 36, where the lower surface 28 can be rigid or of a bladder-type design. As shown in FIGS. 1 and 2, ring 12 has an annular channel 30 opening downward toward the polishing pad 46 with threads 24 on both sides of channel 30 for most of the channel height. Retaining ring 14, which is shown in detail in FIG. 6, has matching threads 24 on its inner and outer surfaces to threadably engage channel 30 in ring 12. Retaining ring 14 is made of DELRIN or other suitable plastic or nylon material or the like, and has a groove 37, preferably v-shaped in its upper surface to receive a metal, similarly shaped (e.g., v-shaped) locking ring 16 which is shown in detail in FIG. 5. A plurality of retaining ring bolts 22 are threaded into ring 12 bearing a load against the top surface of the v-shaped ring 16. FIG. 7 illustrates the relationship among the retaining ring 14 of FIG. 6, the v-shaped locking ring 16 of FIG. 5, the carrier head 18 of FIG. 3, and the fixed ring 12 of FIG. 4.

During operation, retaining ring 14 is threadably engaged into channel 30 up or down on threads 24 so that the vertical displacement of retaining ring 14 can be positioned to a predetermined depth relative to the plane of contact of the wafer substrate 36 with the polishing pad 46. This predetermined depth allows for coarse adjustment of the vertical displacement of the retaining ring. Once coarse adjustment of the vertical displacement of the retaining ring 14 has been achieved, set screws 22 are tightened down, driving v-shaped ring 16 into wedge slot 37 in retaining ring 14, thereby spreading the upper portion of retaining ring 14 against threads 24 to rotationally lock retaining ring 14 in place relative to the carrier head 18. The angle formed by the v-shaped groove 32 is approximately 45 degrees.

Set screws 22 also provide fine positional adjustment of retaining ring 14 vertical displacement as they are tightened. Thus, it is beneficial to coarsely position retaining ring 14 slightly above the precisely desired position via threads 24, then pressing retaining ring 14 down to the exact desired height by tightening set screws 22. In a preferred embodiment, set screws 22 have a socket head for tightening.

Figure 8:
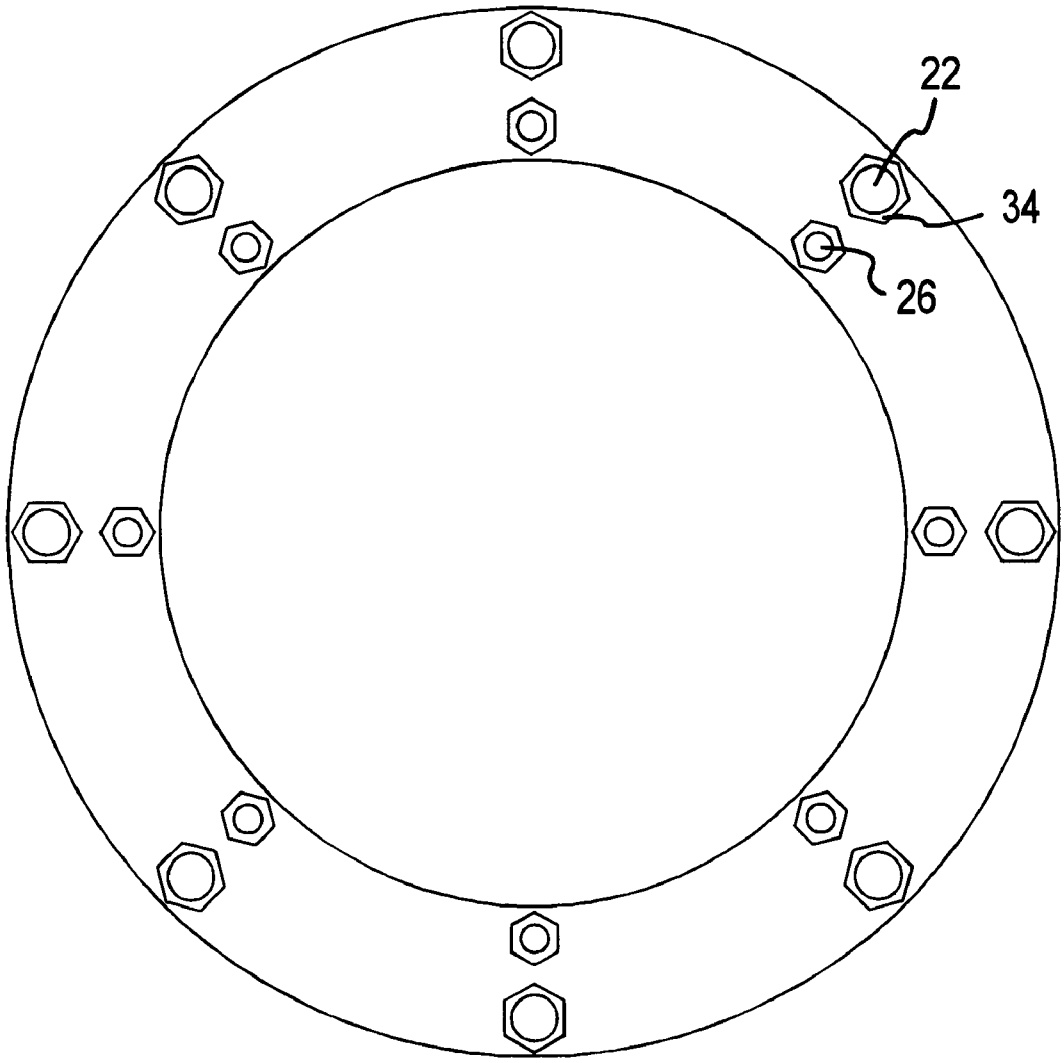
FIG. 8 illustrates a symmetrical arrangement of bolts used in a preferred embodiment of the instant invention.
Figure 9:
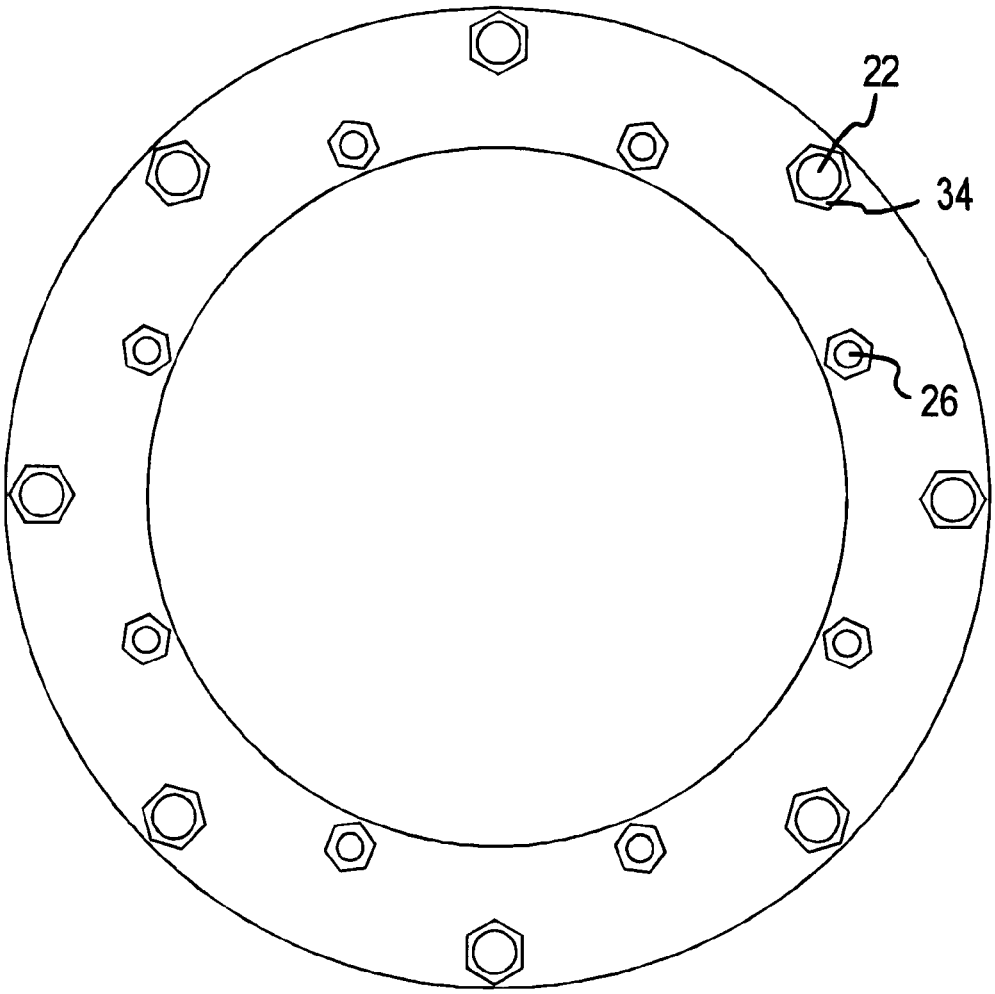
FIG. 9 illustrates a staggered symmetrical arrangement of bolts used in an alternate embodiment of the invention.

In a preferred embodiment, eight (8) set screws 22 are symmetrically arranged in a circular pattern around the perimeter of retaining ring 14 as shown in FIG. 8. In an alternative embodiment, eight (8) set screws 22 are arranged in a staggered symmetrical circular pattern relative to the carrier head attachment bolts 26 as depicted in FIG. 9. Lock nuts 34 lock retaining ring set screws 22 in place.

While the invention has been particularly shown and described with reference to a preferred embodiment, it will be understood by those skilled in the art that various changes in form and detail may be made without departing from the spirit and the scope of the invention.

What is claimed is:

1. A wafer retaining apparatus for use with a chemical-mechanical polishing device, said wafer retaining apparatus comprising a carrier head having at least one substantially planar wafer support surface disposed thereon for supporting a wafer during the polishing process, said carrier head comprising:

a wafer retaining ring having a first and second set of threads; the first set of threads extending circumferentially around the inner diameter of said retaining ring;

the second set of threads extending circumferentially around the outer diameter of said retaining ring; and said carrier head having threadable engagement means for receivably engaging the first and second set of threads of said retaining ring.

2. The wafer retaining apparatus of claim 1, wherein said carrier head further comprises:

a groove disposed upon a lower surface of the retaining ring in contact with the carrier head and parallel to the plane of rotational engagement of said retaining ring with said carrier head;

a locking ring receivably engageable with said groove of said retaining ring; and a lock for bearing pressure down on the locking ring to limit further vertical displacement of said retaining ring.

3. The wafer retaining apparatus of claim 2, wherein said groove is substantially v-shaped and said locking ring is substantially v-shaped.

4. The wafer retaining apparatus of claim 2, wherein said carrier head further comprises a plurality of screws, wherein the plurality of screws provide for a fine adjustment of the vertical displacement of said retaining ring, wherein said lock provides pressure to engage the locking ring with the retaining ring thereby limiting further vertical displacement of said retaining ring.

5. The wafer retaining apparatus of claim 1, wherein said carrier head further comprises a plurality of screws, wherein said plurality of screws provide for a coarse adjustment of the vertical displacement of said retaining ring, wherein said retaining ring is threadably engaged with said carrier head to a predetermined depth relative to the wafer support surface.

6. The wafer retaining apparatus of claim 1, wherein said carrier head is attached to an adjustable ring by a plurality of bolts.

7. The wafer retaining apparatus of claim 6, wherein said plurality of bolts are arranged in a pattern circularly inside the perimeter of said retaining ring.

8. The wafer retaining apparatus of claim 6, wherein said adjustable ring is fabricated from a metal material.

9. The wafer retaining apparatus of claim 1, wherein said wafer retaining ring is fabricated from a thermoplastic material selected from a group consisting of DELRIN; and a nylon material.

10. A method of coarsely adjusting the vertical displacement of a wafer retaining ring, wherein said coarse adjustment comprises threadably engaging the retaining ring with a carrier head to a predetermined depth relative to the wafer support surface.

11. A method of finely adjusting the vertical displacement of a wafer retaining ring, wherein said fine adjustment comprises engaging a locking ring with the retaining ring wherein said locking ring provides adjustable pressure to limit further vertical displacement of the retaining ring.

* * * * *